US006237017B1

(12) United States Patent
Menezes

(10) Patent No.: US 6,237,017 B1
(45) Date of Patent: May 22, 2001

(54) LOSSY TECHNIQUE FOR IMAGE AND SPEECH PROCESSING

(75) Inventor: Vinod Menezes, Bangalore (IN)

(73) Assignee: Texas Instruments India Limited, Bangalore (IN)

( * ) Notice: Subject to any disclaimer, the term of this patent is extended or adjusted under 35 U.S.C. 154(b) by 576 days.

(21) Appl. No.: 08/638,071

(22) Filed: Apr. 25, 1996

(51) Int. Cl.[7] ..... G06G 7/02
(52) U.S. Cl. ..... 708/820
(58) Field of Search ..... 364/826, 725, 364/606, 841; 382/207, 248, 250, 251

(56) References Cited

U.S. PATENT DOCUMENTS 4,288,858 * 9/1981 Merola et al. ..... 364/826
4,335,444 * 6/1982 Blaschke ..... 364/841
5,126,962 * 6/1992 Chiang ..... 364/826
5,619,444 * 4/1997 Agranat et al. ..... 364/841

* cited by examiner

*Primary Examiner*—Tan V. Mai
(74) *Attorney, Agent, or Firm*—Robert L. Troike; Frederick J. Telecky, Jr.

(57) ABSTRACT

The present invention includes a data compression system which implements transformation and quantization functions using analog devites. The system includes a transformation module with analog devices (22), a quantization module with analog devices (24) and an entropy coding module (26). A data decompression system which implements inverse transformation and inverse quantization functions using analog devices is also shown.

12 Claims, 2 Drawing Sheets

LOSSY TECHNIQUE FOR IMAGE AND SPEECH PROCESSING

TECHNICAL FIELD OF THE INVENTION

This invention relates to data compression/decompression and more particularly to a method and system for processing speech or image data using lossy techniques.

BACKGROUND OF THE INVENTION

Conventional image and speech processing techniques use complex digital logic. This complex digital logic usually consists of multipliers, adder/subtractors, and shift registers. Such devices are very precise and high precision can be maintained. Digital Signal Processing (DSP) algorithms used for image and speech processing use such devices in the implementation of image processing/image compression, high definition television (HDTV), and various other multimedia applications.

However, very precise arithmetic is not always needed in every speech and image processing/compression application. In some cases, simple analog devices and/or circuits can be used with some amount of signal loss/noise without adversely affecting the result of the processing/compression.

Image and speech processing/compression done in real time (on the fly), also require very high computing throughput and communication bandwidth. This, in turn, requires very high speed and specialized equipment. Since image processing/compression can take advantage of parallelism, a number of digital, parallel processing devices have been designed for processing/compression.

Real-time speech and image processing and compression can be achieved using analog techniques along with high bandwidth operational amplifiers (opamps). Opamps are devices which can be configured to perform multiplication, addition, subtraction, and other arithmetic operations with relative ease and minimal complexity.

FIGS. 1A and 1B illustrate building block used to implement various steps of an image processing/compression algorithm FIG. 1A illustrates a very general image compression technique currently being used. Image data is captured by a camera/scanner and the sensed image data is digitized. A transformation function (such as a Discrete Cosine Transform (DCT)) is then applied to the digitized data by Transformation Module 10. The coefficients of the transform are then quantized by Quantization Module 12 (i.e., divided by a predetermined number) in that fewer bits are required to code small numbers as compared to coding larger numbers. The quantizer output goes to an Entropy Coding Module 14 which uses, for example, a Huffman coding technique. The resulting processed/compressed data is then stored or transmitted as the compressed image.

The FIG. 1B illustrates the inverse process in which the stored or transmitted data is decompressed to get back the original image data. The system shown in FIG. 1B includes an Entropy Decoding Module 16, an Inverse Quantization Module 18 and an Inverse Transform Module 20.

SUMMARY OF THE INVENTION

The present invention is a very novel approach to the problem of data compression/decompression. The method and system of the present invention differ from conventional techniques in that analog circuits are used to perform the transformation and quantization functions. The capability to add, multiply, and quantize are intrinsic to the analog circuits and these characteristics can be exploited in calculations where approximations can be tolerated.

These and other features of the invention that will be apparent to those skilled in the art from the following detailed description of the invention, taken together with the accompanying drawings.

DETAILED DESCRIPTION OF THE INVENTION

In the present invention, a compression and decompression method and system are described which use analog elements to perform the Transformation and Quantization functions. Although the compression and decompression system and method of the present invention use analog elements in the Transformation and Quantization functions, some amount of digital logic is used to interface to input or output digital data.

Figure 2A:
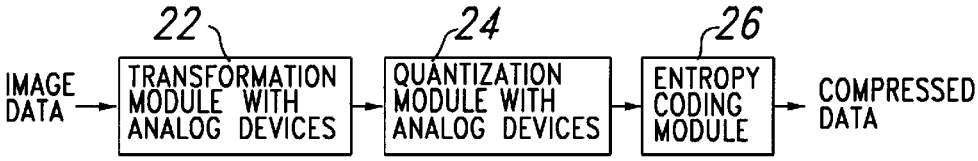
FIGS. 2A and 2B illustrate block diagrams of a data compression system and decompression systems, respectively, in accordance with the present invention.
Figure 2B:
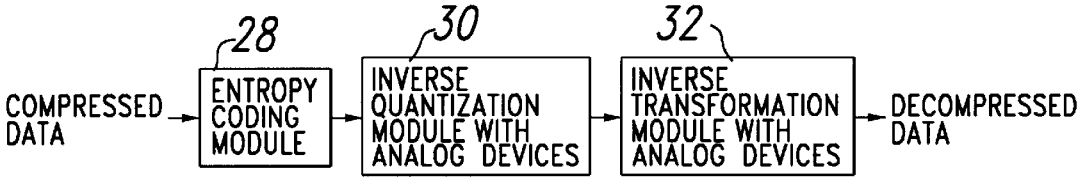

FIG. 2A shows a data compression system in accordance with the present invention. The system shown in FIG. 2A includes a Transformation Module With Analog Devices 22, a Quantization Module With Analog Devices 24, and an Entropy Coding Module 24. FIG. 2B illustrates a data decompression system in accordance with the present invention. The system shown in FIG. 2B includes an Entropy Decoding Module 28, an Inverse Quantization Module With Analog Devices 30, and an Inverse Transformation Module With Analog Devices 32. The analog devices used to implement the Transformation Module 22, the Quantization Module 24, the Inverse Transformation Module 32 and the Inverse Quantization Module 30 are discussed in more detail hereinbelow.

Figure 3:
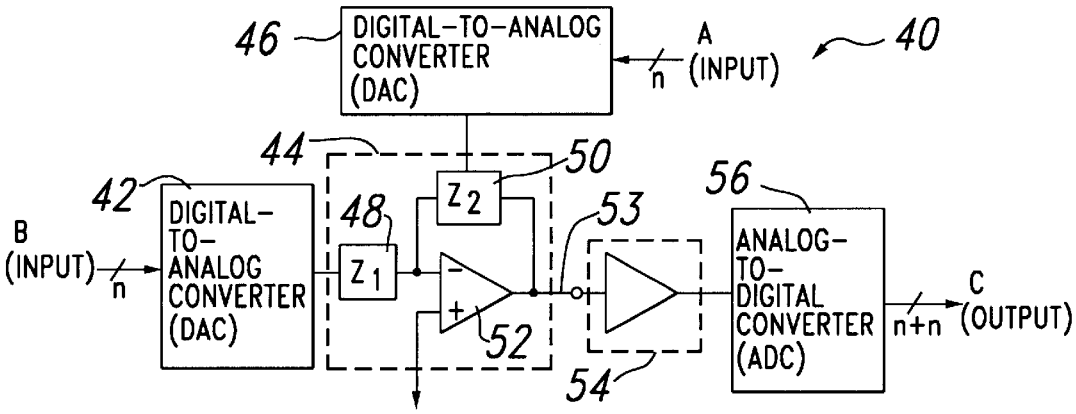
FIG. 3 shows an analog multiplier used in one embodiment of the present invention.

FIG. 3 shows a multiplier 40 which uses analog elements. Consider, as an example, two digital number, A and B, which are to be multiplied. Using the multiplier 40 shown in FIG. 3, the two digital numbers are first input into digital-to-analog converters (DACs) 42 and 46. The digital number B is converted and fed into the input load $Z_1$ 48 of feedback amplifier 52. The digital number A is converted and used to control the gain of the feedback amplifier 52 by controlling the feedback loop load $Z_2$ 50.

Figure 1A:
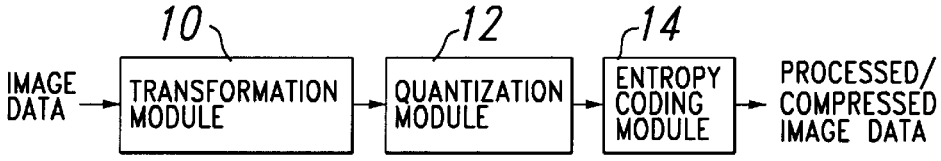
Fig.1A PRIOR ART
FIGS. 1A and 1B are block diagrams of a prior art data compression and decompression systems, respectively.
Figure 1B:
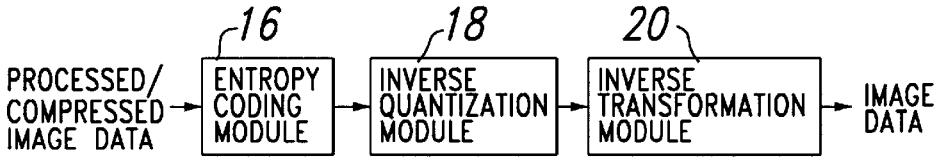
Fig.1B PRIOR ART
Figure 4:
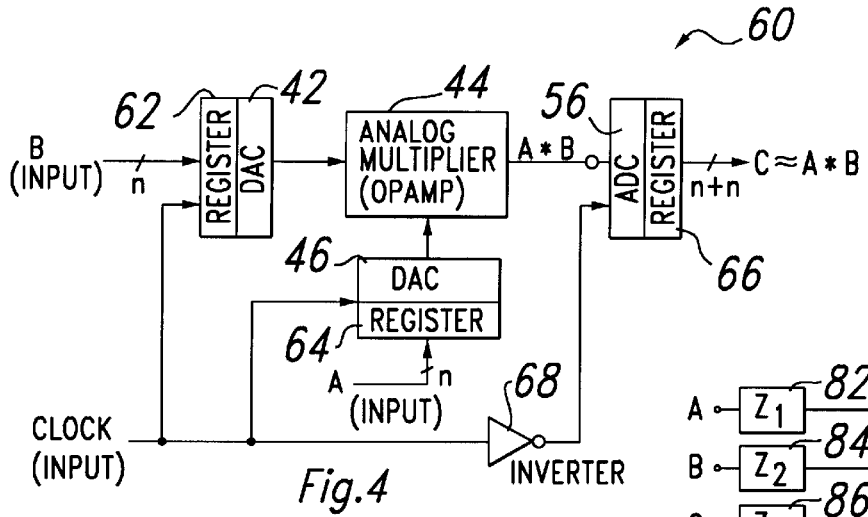
FIG. 4 depicts a pipelined analog multiplier used in one embodiment of the present invention.

The output at 53 of the feedback amplifier 52 (-(A*B)) is in analog voltage form and is inverted by buffer/inverter 54 if required for the particular application. The analog product is converted to digital form for output by analog-to-digital converter (ADC) 56. The ADC 56 is actually a quantizer and can be used for quantization in the compression method described hereinabove and illustrated in FIG. 1A FIG. 4 shows a schematic of a pipelined analog multiplier 60 and is an exemplary implementation of the multiplier 40 shown in FIG. 3, except that the pipelined analog multiplier 60 in FIG. 4 executes with a synchronous clock.

Figure 5:
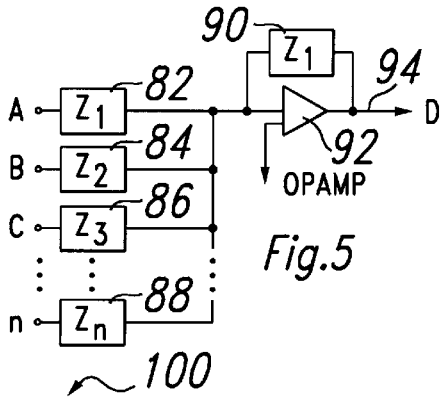
FIG. 5 shows an analog adder used in one embodiment of the present invention.

FIG. 5 illustrates addition/subtraction of N number using an opamp 92 in an adder configuration. The output D at 94 is the result of the addition. The output D 94 may be scaled as needed for the particular application.

Most transform algorithms are of the form SIGMA($H_i \times V_i$)=$\Sigma H_i \times V_i$ where $H_i$, $V_i$ is a matrix of input data. The technique used to implement the transformation function in the present invention using lossy multiplication and addition uses the analog multiplier 40, or the pipelined analog multiplier 60, and the analog adder 100, each of which is described hereinabove, as building blocks.

Figure 6:
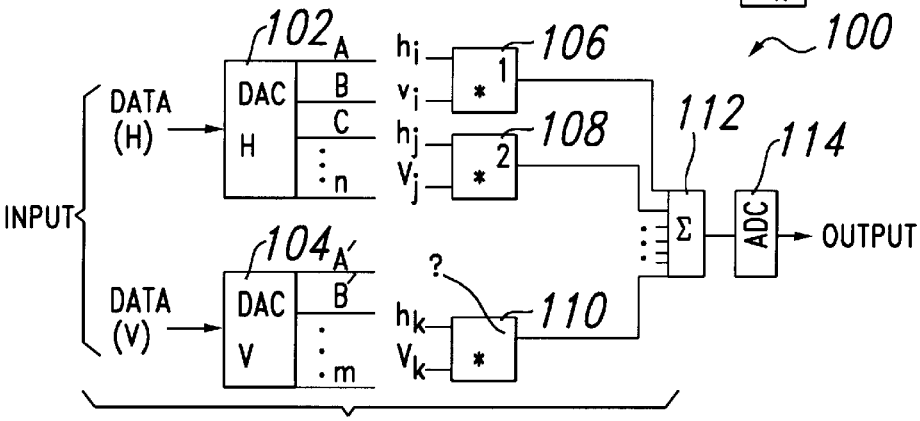
FIG. 6 is one embodiment of a transformation function in accordance with the present invention which uses analog multiplier and analog adder devices.

FIG. 6 depicts at 100 an implementation of the generalized transformation function SIGMA($H_i \times V_i$).

A particular implementation of the generalized transformation function SIGMA($H_i \times V_i$) 100 is the Discrete Cosine Transform (DCT), which is very often used. An example of the DCT transformation using the general transformation function $\Sigma\ H_i \times V_i$ is shown below:

$$F(u, v) = \frac{1}{4} C(u) \cdot C(v) \left[ \sum_{x_0}^{7} \sum_{y_0}^{7} f(x, y) * \frac{\cos(2x+1)u\Pi}{16} * \cos(2y+1)v\Pi \right]$$

where $$f(x, y) = \frac{1}{4} \left[ \sum_{u=0}^{7} \sum_{v=0}^{7} C(u) \cdot C(v) F(u, v) * \frac{\cos(2x+1)u\Pi}{16} * \frac{\cos(2y+1)v\Pi}{16} \right]$$

and where C(u), C(v)=1/√2 for U,V=Ø and C(u), C(v)=1 otherwise.

To make the design more cost effective, some amount of synchronization can take place after breaking the image into blocks and processing those blocks synchronously instead of processing each block in parallel.

Figure 7:
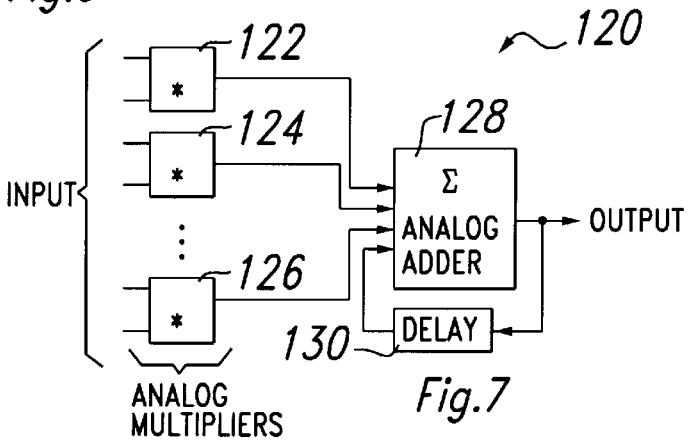
FIG. 7 illustrates one embodiment of a quantization function in accordance with the present invention which uses analog multiplier and analog adder devices.

FIG. 7 illustrates how the previous sum of an addition can be added to the new sum, using the same hardware, run in a serial fashion.

If all of the input image picture elements (pixels) are directly available in analog form from a camera or scanner, the input stage analog-to-digital converter is not required, and the analog signals can be either directly used or buffered and scaled by an OPAMP and fed to later processing stages. This avoids the cost and processing delay of the input analog-to-digital converters.

Quantization in a data compression/decompression system using the system and method of the present invention is accomplished by either feeding the output analog voltage to a multiplier OPAMP, to perform the division, or by using the ADC as a quantized. Thus, while the ADC is required to convert the analog output to digital form for the Entropy encoder, the ADC itself is a quantizer and can be programmed to the desired quantization.

The Reverse process of decompressing the data from the compressed format to the image data also uses the method and system described hereinabove to perform the inverse quantization and the inverse transformation to generate the final compressed or decompressed image data.

The present invention thus describes how simple analog circuits can be connected together to implement the data compression/decompression algorithms used in image and speech processing applications.

Other Embodiments

Although the present invention and its advantages have been described in detail, it should be understood that various changes, substitutions and alterations can be made herein without departing from the spirit and scope of the invention as defined by the appended claims.

What is claimed is:

1. An data compression system comprising collector means for collecting said data;

a transformer coupled to said collector means for transforming said data to generate transform coefficients, said transformer implemented using analog devices;

a quantizer coupled to said transformer for quantizing said transform coefficients to generate quantized coefficients, said quantizer implemented using analog devices; and an encoder coupled to said quantizer for encoding said quantized coefficients to generate compressed data.

2. The system of claim 1 wherein said analog devices include an analog multiplier comprising a feedback amplifier.

3. The system of claim 1 wherein said analog devices include a pipelined analog multiplier comprising a feedback amplifier.

4. The system of claim 1 wherein said analog devices include an analog adder.

5. The system of claim 4 wherein said analog adder includes an operational amplifier.

6. The system of claim 1 wherein said quantizer is further operable to digitize said quantized coefficients.

7. The system of claim 1 wherein said transform implements a discrete cosine transform.

8. The system of claim 1 wherein said encoder uses a Huffman coding technique.

9. An data compression method comprising the steps of:

collecting said data;

transforming said data to generate transform coefficients, said transformer implemented using feedback amplifier;

quantizing said transform coefficients to generate quantized coefficients, said quantizer implemented using analog devices; and encoding said quantized coefficients to generate compressed data.

10. An data compression system comprising:

collector means for collecting a matrix $H_i$, $V_i$ of said data for compression;

a transformer coupled to said collector means for transforming said matrix of data to generate transform coefficients, said transformer implemented using analog devices including a plurality of operational amplifier multipliers;

a quantizer coupled to said transformer for quantizing said transform coefficients to generate quantized coefficients, said quantizer implemented using analog devices; and an encoder coupled to said quantizer for encoding said quantized coefficients to generate compressed data.

11. The system of claim 10 wherein said transformer includes a digital to analog converter for each input $H_i$ and $V_i$ and the converted outputs are applied respectively to an input and gain control of an operational amplifier.

12. An data compression system comprising:

collector means for collecting a matrix of data for compression;

a transformer coupled to said collector means for transforming said matrix of data to generate transform coefficients, said transformer implemented using analog devices including a plurality of operational amplifiers coupled to an adder including an operational amplifier;

a quantizer coupled to said transformer for quantizing said transform coefficients to generate quantized coefficients, said quantizer implemented using analog devices; and an encoder coupled to said quantizer for encoding said quantized coefficients to generate compressed data.

* * * * *